United States Patent [19]

Snyder et al.

[11] Patent Number: 4,740,034

[45] Date of Patent: Apr. 26, 1988

[54] PROTECTIVE STOOL BUMPER

[76] Inventors: William F. Snyder, 2174 Temple Rd.; Robert L. Snyder, 426 E. Lucas St., both of Bucyrus, Ohio 44820

[21] Appl. No.: 23,238

[22] Filed: Mar. 9, 1987

[51] Int. Cl.[4] ..... A47C 27/00

[52] U.S. Cl. ..... 297/452; 5/402; 248/345.1; 297/218

[58] Field of Search ..... 297/461, 462, 452, 219, 297/218; 5/474, 471, 402, 409; 248/345.1; 52/718, 717, 716, 715, 254, 287, 288, 211, 213

[56] References Cited

U.S. PATENT DOCUMENTS

| | | | |
|---|---|---|---|
| D. 30,192 | 2/1888 | Hegman . | |
| D. 79,649 | 8/1929 | Ekvall . | |
| D. 139,131 | 10/1944 | Sullivan et al. . | |
| D. 160,129 | 5/1950 | Scott . | |
| D. 179,592 | 1/1957 | Cramer . | |
| D. 181,730 | 12/1957 | Jones et al. . | |
| D. 182,213 | 2/1958 | Wiederhold . | |
| D. 194,841 | 3/1963 | Ridder et al. . | |
| 2,168,919 | 8/1939 | Sullivan | 5/474 X |
| 3,871,041 | 3/1975 | Plume | 5/402 |
| 3,981,534 | 9/1976 | Wilton | 5/402 |
| 4,012,878 | 3/1977 | Ellingson | 52/716 |

FOREIGN PATENT DOCUMENTS

| | | | |
|---|---|---|---|
| 1554341 | 11/1969 | Fed. Rep. of Germany | 248/345.1 |

*Primary Examiner*—James T. McCall

*Attorney, Agent, or Firm*—Oldham, Oldham & Weber Co.

[57] ABSTRACT

A stool upholstered with a protective stool cover, and related objects are shown. The cover comprises a seat encapsulating, cover material, the lower edge of which is attached to a seat pan covering, shaped wall profile which protects against inadvertant, cover material damaging impact against the seat pan. The profile also eliminates the discernment of outlines of the edge of the interface between the seat pan and the cushioning material through the covering material. The profile includes a flange section adapted for attachment to the lower side of the seat pan, which extends at substantially right angles from one end of the seat pan edge covering collar section, as well as a seam section adapted for sewn attachment to the covering material. The seam section is offset and extends from the other end of the collar section, parallel and adjacent to a line of extension therefrom.

8 Claims, 2 Drawing Sheets

PROTECTIVE STOOL BUMPER

This invention relates to a bumper for protecting stool seat covers. More particularly, this invention relates to a protective bumper strip fastened about the side of stool seat covers to protect the covers from damaging impact thereto, and to eliminate discernible outlines showing internal structure of the stool seat. Specifically, this invention relates to a protective welt formed with a shaped profile attached to the lower side of stool seat covers which prevents contact of the seat cover with the seat pan of the stool, and therefore, substantially reduces the possibility of damage from, and unsightly outlines caused by the stool seat pan.

BACKGROUND OF THE INVENTION

Furniture stools of the type used to support seated individuals engaged in work of one type or another, or to give seated support to individuals involved in a variety of other activities, find widespread use in today's work place, homes, and elsewhere. The usual form of construction of such stools comprises a rigid platform, commonly termed a "seat pan", mounted on a pedestal, legs, or other support. Very often, the seat pan is covered with upholstering, commonly a foamed material, in order to make the stool more comfortable, particularly, when it is to be used for long periods. In such instances, the seat pan-foam laminate is covered with material to give the stool a pleasing appearance. While such construction is both attractive and comfortable, it has been found that the edge of the seat pan constitutes an area of high wear. Furthermore, the edge of the interface between the upholstering material and the seat pan is often discernible through the seat covering material, resulting in a relatively unattractive appearance. Usually in the past, such outlines and the damage to stool seat covers caused by impact of objects with the cover in the vicinity of the hard, abrasive seat pan have been accepted as the price of the stool construction described. There have, however, been some attempts to avoid the problem, for example, by forming a laminate comprising a welt on the outside of the seat cover adjacent to the lower edge of the seat pan, and a strip of foam on the inside of the seat cover adjacent the seat pan's edge. While such an approach helps the impact damage problem, it does not avoid the objectionable outline of the interface between the seat pan and the upholstery cushion. In addition, such an approach requires fastening the protective strips, i.e., the welt and the foam strip, opposite each other on both sides of the seat cover, a demanding process.

DISCLOSURE OF THE INVENTION

In view of the foregoing, therefore, it is a first aspect of this invention to provide a stool bumper which not only eliminates damage to the stool cover from inadvertant impacts, but also successfully hides the cushion-seat pan interface outline.

A second aspect of the disclosed invention is the provision of a simplified, single component, protective stool bumper.

Another aspect of the invention is to substantially increase the degree of protection provided to stools, including their seat covers.

A further aspect of the described invention is to provide stools with improved appearance, without unsightly outlines from internal structural details.

Yet another aspect of this invention is to make available protective stool bumpers which may be easily attached to stool covers.

These and other aspects are provided by a protective stool welt profile having a shaped wall comprising:

a flange section, a collar section, and a seam section, said flange section extending from one end of said collar section at substantially right angles thereto, and said seam section extending from the other end of said collar section substantially adjacent and parallel to a line of extension therefrom, both said flange and seam sections being positioned on the same side of said collar section.

Yet other aspects are achieved by a stool cover whose side comprises a shaped covering material, and whose top comprises covering material having the cross-sectional shape of said shaped covering material, and wherein a protective stool welt profile as described in the preceeding paragraph is parametrically fastened to the lower side of said stool cover.

Still other aspects of the invention are obtained in a stool having a seat covered with a stool cover as described in the preceeding paragraph, in which said seat has an infrastructure comprising a seat pan with a cushion positioned thereon, wherein the height of said collar section is at least that equal to the thickness of said seat pan, and wherein said flange section is attached to the bottom of said seat pan.

BRIEF DESCRIPTION OF THE DRAWINGS

The invention will be better understood by reference to the following drawings, in which like numbers refer to like parts, and in which.

BEST MODE FOR CARRYING OUT THE INVENTION

Figure 1:
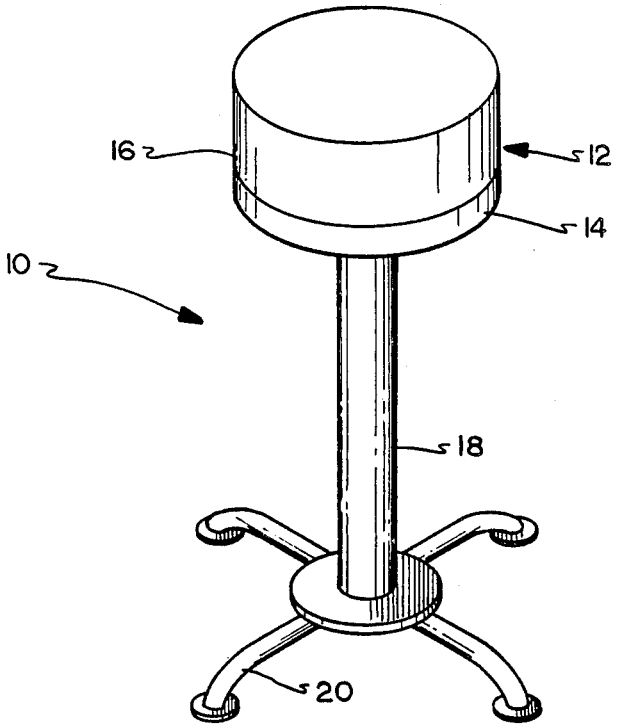
FIG. 1 is an isometric view of a covered stool provided with a protective stool bumper of the type contemplated by the invention.

FIG. 1 shows an isometric view of a pedestal-type stool 10, mounted on a pedestal 18, supported by a base 20. As shown, seat 12 comprises cushion 16 positioned on seat pan 14, the seat being upholstered with a protective cover. While a pedestal-type stool is shown with a round seat component, the invention disclosed is equally applicable to stool seats of different shapes, with different leg support structures.

Figure 2:
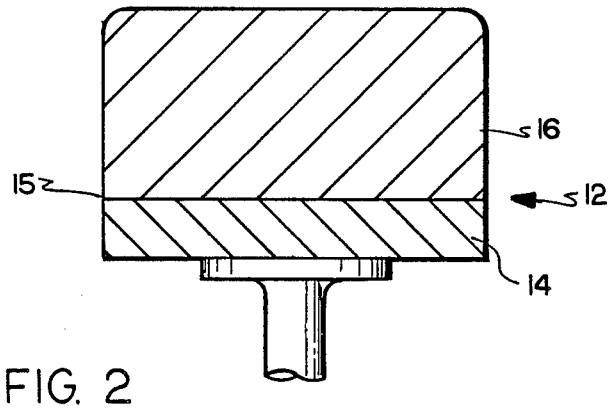
FIG. 2 is a cross section of an uncovered stool seat showing details of its inner infrastructure.

FIG. 2 illustrates a cross section of the seat region 12 of an uncovered stool showing details of the seat's inner construction including cushion 16 mounted on seat pan 14. The edge 15 of the interface between cushion 16 and seat pan 14 is the point at which an unpleasing, revealing outline through the stool cover often occurs, in the absence of the protective stool welt profile which is the subject of the invention. While the cushion 16 may be made from a variety of upholstering materials such as batting, fibrous material, various foam materials, and the like, the use of cellular foams made from synthetic materials such as, for example, open-celled, polyurethane foams has been found to be particularly desirably. The thickness of the foam used is largely a matter of the cushion firmness desired; however normally, a cushion with a thickness of at least about 1 and ½ inches will be employed. Seat pan 14 can be made from various rigid materials such as metal, hardboard, wood, including plywood, and similar materials. Wood is frequently used, since it is inexpensive, easily formed in the desired shape, and since it facilitates fastening of the seat cover to its bottom side. A seat pan made from plywood ½ to 1 inch thick is oftentimes employed in stools similar to that shown in FIG. 1.

Figure 3:
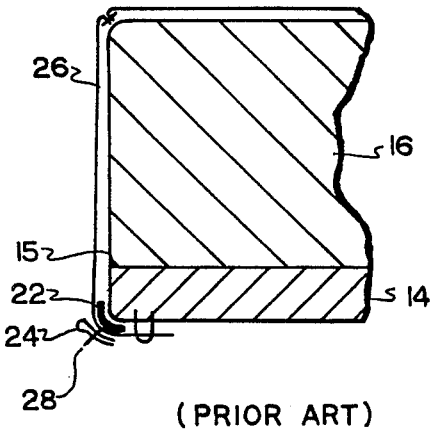
(PRIOR ART) FIG. 3
FIG. 3 is a cross sectional partial view of a stool whose cover is protected by a system known in the prior art.

FIG. 3 shows a cross sectional view of a portion of a stool whose cover is protected by a system known in the prior art. In the Figure, the outside lower edge of seat pan 14 is protected by a laminate structure consisting of a strip of foamed material 22, such as foamed polypropylene, together with a decorative welt 24 which helps to insulate the seat pan edge from impact, the seat covering material 26 being sandwiched between the welt and foam strip. While the system described protects the covering material 26 from being damaged by the edge of seat pan 14 in the event of outside impacts on the stool, the upper outer edge of seat pan 14, at the point of interface with cushion 16 is unprotected. Furthermore, the covering material, is normally drawn tightly over the seat infrastructure, making the edge of the interface 15 of seat pan 14 with cushion 16 readily and unattractively visible through cover material 26.

Figure 4:
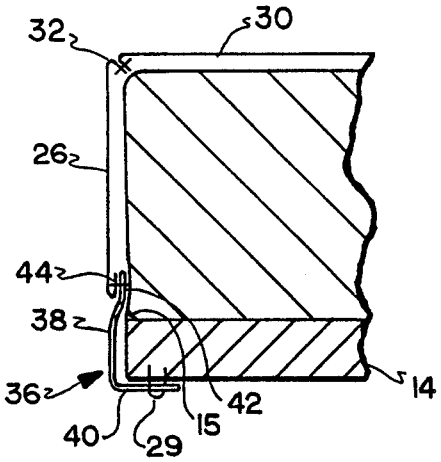
FIG. 4 shows a cross sectional view of a stool the cover of which is protected by a stool bumper profile of the invention.

FIG. 4 shows a cross sectional view of a portion of a stool protected by the stool welt profile 36 of the invention. In the Figure, the stool welt profile is shown comprised of a profile having a collar section 38, a flange section 40, and a seam section 42. Seam section 42 is secured by seam 44 to the circular, tubular shaped covering material 26 which encompasses the stool. The tubular shaped covering material 26 is closed at its upper end by a piece of covering material 30 which has the same cross sectional shape as the tubular shaped covering material, and is fastened to the latter by seam 32. In the Figure, a staple 29, driven through flange section 40, fastens the seat cover to a wooden seat pan 14. The Figure illustrates how the welt profile 36 completely covers seat pan 14, including the edge of the seat pan-foam interface 15, thus avoiding damaging contact of the seat covering material with the sharp edges and abrasive fibers of the wooded seat pan 14, and preventing the interface from being seen. The seat covering material 26 and 30 may be chosen from any of various materials such as cloth, plastics, or fabric-backed plastics. Frequently, however, vinyl covering materials will be selected, particularly those backed with fabrics such as nylon or polyester. The cover may be fastened to the seat on the bottom of the seat pan by means of staples, tacks, adhesives, or otherwise, depending upon the material from which the seat pan 14 is made.

Figure 5:
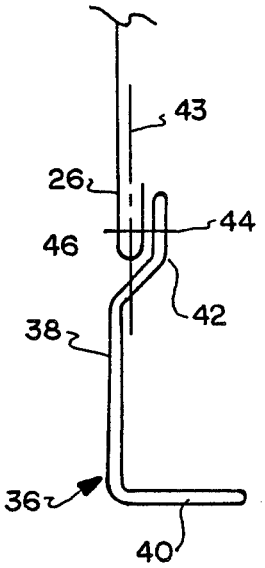
FIG. 5 is a cross sectional view of a protective bumper profile of the invention illustrating its attachment to a stool cover.

FIG. 5 shows a cross sectional view of the protective bumper profile of the invention, including the method of its attachment to a stool cover. In the Figure, the protective bumper profile 36 is shown comprising the collar section 38, flange section 40, and the seam section 42. As indicated, the flange section 40 is disposed at substantially right angles to the collar section 38, while the seam section 42 extends from the collar section substantially adjacent and parallel to a line of extension 43 extending from the collar section. This places the seam section 42 on the same side of the collar section 38 as the flange section 40. The offset of seam section 42 from collar section 38 accomodates the attachment of the covering material 26, for example, by sewn seam 44. Although a single thickness of the covering material 26 may be attached to seam section 44, a reverse doubling of the covering material 26 produces a neat appearing folded edge 46 which is accomodated in the offset producing a smooth line along the outer surface of collar section 38 and covering material 26. The protective stool welt profile 36 may be made from a variety of flexible materials such as, for instance, rubber, plastic such as PVC, polyethylene, polypropylene, nitrile plastics, and others. Within the shape described, the dimensions of the protective stool welt profile 36, which may advantageously be fabricated by extrusion, may be varied within limits determined by functional considerations. For example, the thickness of collar section 38, usually about 1/16 to ⅛ inch, will be selected so that sufficient stiffness is imparted to hide the telltale outline of the edge of interface 15, and at the same time so that sufficient cushioning is present to provide protection from ordinary, inadvertant impacts. The height of collar section 38 will depend upon the thickness of seat pan 14 and will be such that the edges of the seat pan is accomodated within the collar section. The flange section will be thick enough so that the fastening means, whether staples, tacks, or otherwise, will be capable of securely fastening the seat cover assembly, including profile 36, to the seat pan 14. The thickness of flange section 40 will depend somewhat upon its length, the object simply being to furnish a secure anchoring surface. Normally, a flange about ½ to ¾ inch long, and about 1/16 of an inch thick will be adequate for the purpose. Similar considerations will determine the design of the seam section 42, whose offset from the collar section will be designed to accomodate a double thickness of the covering material, thereby producing a substantially smooth line along the outside surfaces of the covering material and the profile. The height and thickness of the seam section 42 will be chosen so that a sewn seam, for example, of bonded nylon or other suitable thread, may securely attach the seam to the covering material. Ordinarily, however, seam section 42 will be from about ¼ to ½ inch high and about 1/16 inch thick. Although the profiles illustrated in the Figures show a smooth outer surface of collar section 38, more decorative surfaces may be used if desired, including, for instance, irregular surfaces and the like.

Figure 6:
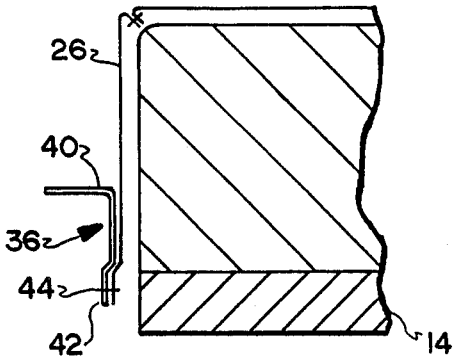
FIG. 6 shows a cross sectional partial view of a stool in the process of having installed thereon a cover to which a protective bumper profile of the invention has been attached.

FIG. 6 shows a cross sectional view of a portion of a stool in the process of being covering with covering material to which a protective bumper profile of the invention has been attached. The Figure is useful in illustrating the simplified process of attaching the protective profile 36 to the tubular covering material 26. As can be seen in the Figure, the profile 36 is placed adjacent to tubular covering 26, and a seam 44 is sewn along the seam section 42. This process benefits from comparison to the complicated process of the system of the prior art, shown in FIG. 3, which requires careful alignment of welt 24 with foam strip 22, on either side of the covering material 26, before seam 28 can be sewn, attaching the three components together. In FIG. 6, the seat covering is slipped over the stool seat, as shown, whereupon profile 36 is folded over so that flange section 40 is adjacent to the lower surface of seat pan 14, following which the latter is fastened by staples, or otherwise, as previously described.

While circular stools and stool coverings are illustrated in the Figures, the protective stool welt profiles of the invention also have application to other seat shapes such as, for example, polygonal, irregular, and other configurations.

While in accordance with the patent statutes, the preferred embodiment and best mode has been presented, the scope of the invention is not limited thereto but rather is measured by the scope of the attached claims.

What is claimed is:

1. A protective stool welt profile having a shaped wall comprising:

a flange section;

a collar section, and a seam section, said flange section extending in a substantially horizontal plane from one end of said collar section at substantially right angles thereto, and said seam section extending from the other end of said collar section and being offset from said collar section so that said seam section is substantially adjacent and parallel to a line of extension from said collar section, both said flange and seam sections being positioned on the same side of said collar section, and said flange section being fastenable to the lower surface of the seat pan of a stool.

2. A stool cover whose side comprises a shaped covering material, and whose top comprises covering material having the cross sectional shape of said shaped covering material, and wherein a protective stool welt profile according to claim 1, is parametrically fastened to the lower, open end of said stool cover.

3. A stool cover according to claim 2 in which said shaped covering material is substantially tubularly shaped.

4. A stool having a seat covered with a stool cover according to claim 2 in which said seat has an infrastructure comprising a seat pan with cushioning material positioned thereon, wherein the height of said collar section is at least about equal to the thickness of said seat pan, and wherein said flange section is attached to the bottom of said seat pan.

5. A stool according to claim 3 in which said protective stool welt profile is fabricated from a flexible extruded material.

6. A stool according to claim 4 in which said cushion is made from a foamed, cellular material, while said seat pan is fabricated from a material containing cellulosic fibers, and wherein said covering material is polyvinylchloride plastic.

7. A protective stool welt profile according to claim 1, wherein said profile is fabricated from a material comprising a blend of nitrile rubber and PVC.

8. A stool according to claim 5 in which said flexible extruded material comprises a blend of a nitrile rubber and PVC.

* * * * *